United States Patent [19]

Yeu

[11] 4,341,036

[45] Jul. 27, 1982

[54] STUFFED TOY

[76] Inventor: Nam J. Yeu, 16-35 Hwayang-Dong, Seongdong-Ku, Seoul, Rep. of Korea

[21] Appl. No.: 198,650

[22] Filed: Oct. 20, 1980

[51] Int. Cl.[3] ..... A63H 3/00

[52] U.S. Cl. ..... 46/151

[58] Field of Search ..... 46/151, 163, 161, 158, 46/162, 154, 123, 159, 160

[56] References Cited

U.S. PATENT DOCUMENTS 1,968,492 7/1934 Kallus ..... 46/161

2,760,303 8/1956 Del Mas ..... 46/163 X

*Primary Examiner*—Gene Mancene

*Assistant Examiner*—Mickey Yu

*Attorney, Agent, or Firm*—Fleit & Jacobson

[57] ABSTRACT

A toy figure including an elongated, one-piece flexible, plastic tube extending longitudinally from a portion of the head and continuously through the body and terminating at the bottom portion thereof for restoring the toy figure to its original condition after the toy figure has been deformed. Two abutment elements are also provided and are held together by a rope to the ends of the tube. The toy figure further includes two clamps located at its limbs and are connected to the tube.

5 Claims, 2 Drawing Figures

STUFFED TOY

FIELD OF THE INVENTION

A toy with the ability to assume its original shape or state even after being pressed or squeezed radically out of shape.

DETAILED DESCRIPTION OF THE INVENTION

Figure 1:
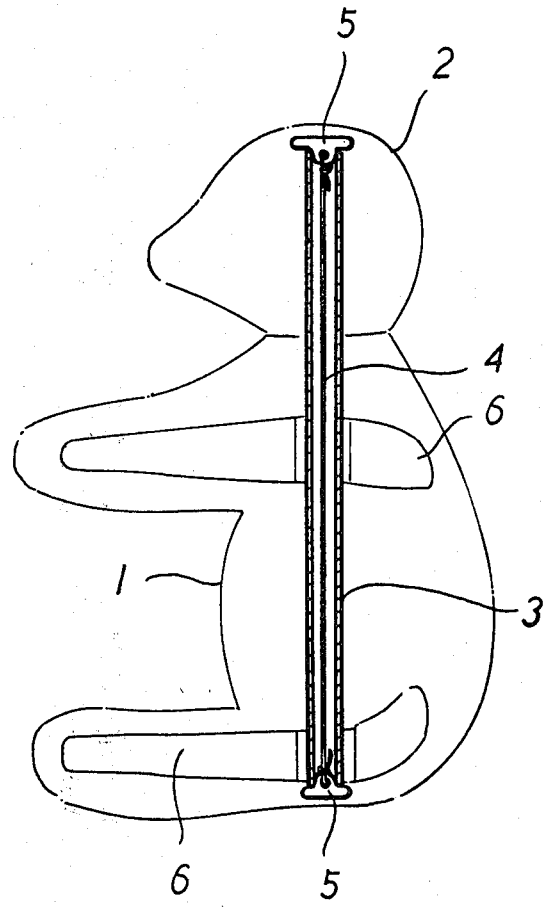
FIG. 1 is a cross-sectional view which shows the essential parts of the toy of this invention.
Figure 2:
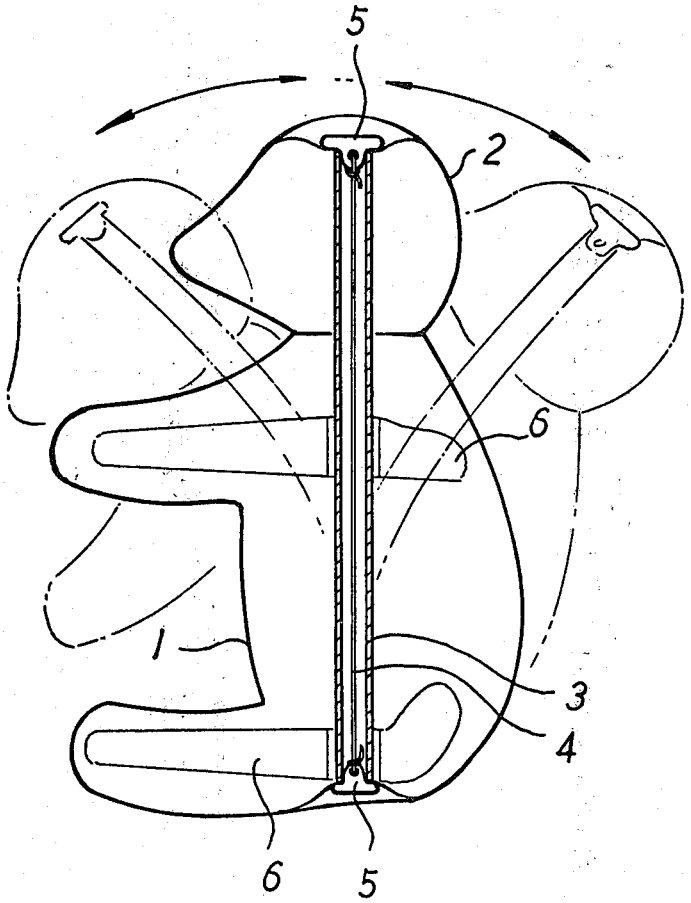
FIG. 2 is a view similar to FIG. 1 showing the trunk of the animal toy restored to its original state from deformed conditions shown by phantom lines.

The present invention relates to a toy which is capable of automatically returning to its original condition even when the head portion is pressed or squeezed out of the shape in angular relation against the trunk of the toy by children, for example. As for coupling of the head part to the trunk portion, conventional toys were linked by way of an iron core in which both ends of which passed through holes penetrating the central part of the head and trunk portion in such a way that the head portion was movable, i.e., rotatable but not returning to its original condition after having been deformed.

The parts connected by the iron core, had a defect in which the toys were altered or the heads were made immovable when crushed or squeezed by children.

An object of this invention is to overcome defects of the prior art. The present invention provides the toys with a restoring ability even in cases where the toys are radically crushed or pressed and deformed. The head portion and trunk part are connected by a twisted rope or flexible element, the outside of which rope being fully covered or enclosed by a flexible resin tube. The head and trunk parts of the toys, therefore, are restored to the original state of the toy through the expedient with the aid of flexibility of the twisted rope and synthetic-resin tube even in the event the toys are radically crushed or squeezed by children during play.

Referring to a drawing, the flexible resin tube (3) is inserted through suitable holes extending vertically or longitudinally through a central part of the head (2) and trunk of the body of the toy. Inside the tube is a one-piece twisted rope (4) extending completely therethrough. One end of the twisted rope (4) is attached to a holding or abutment device (5) arranged at the upper part of the head (2), while the other end of the rope is attached to a second holding device or abutment element (5) installed at the lower part of the trunk (1). Numeral with numeral mark 6 indicates clamping devices generally disposed at the arm and leg portions of the toy, and which clamps extend laterally from intermediate portions of the toy, as shown.

Thus, the head (2) and trunk (1) of the toy are linked by the twisted rope (4), which was covered by a soft and flexible resin-made one piece tube (3). The toy, therefore, is restored to the original state or condition by both the tube and rope 4 even when it is altered by children playing with it. The present invention is disclosed, is sturdy and restoration prevents it from possible breakage, and gives a longer life for play by the children.

What is claimed is:

1. A toy comprising in combination a one-piece body portion and an integral head portion; and restoring means extending longitudinally through both said head and said body portions for restoring the toy to its original condition after having been deformed, said means comprising, an elongated, one-piece flexible, plastic tube extending longitudinally from a portion of said head and continuously through said body and terminating at a bottom portion of said body, a one-piece flexible element extending through said flexible tube and being secured at opposite ends to means at the opposite ends of the tube whereby radical deformations of said head relative to said body are obviated and the original condition and position of said head relative to the toy body is restored by the force of said flexible tube and flexible element.

2. The structure as claimed in claim 1 in which said flexible plastic tube comprises a resin.

3. The structure as claimed in claim 1 in which said means at opposite end of said flexible tube for securing the flexible element comprises abutment elements projecting into the ends of said flexible tube and to which the opposite, respective ends of the flexible element are fixedly connected.

4. The structure as claimed in claim 1 in which at least one clamping means is secured to an intermediate portion of said flexible tube and projects laterally therefrom into said body.

5. The structure as claimed in claim 4 in which a second clamping means is connected to said flexible tube, said respective clamping means extending from simulated arm and leg portions of the body portion of said toy.

* * * * *

UNITED STATES PATENT AND TRADEMARK OFFICE

CERTIFICATE OF CORRECTION

PATENT NO. : 4,341,036

DATED : July 27, 1982

INVENTOR(S) : Nam J. YEU

It is certified that error appears in the above—identified patent and that said Letters Patent is hereby corrected as shown below:

On the title page before line "[51]", insert:

[30] Foreign Application Priority Data

March 28, 1980 Republic of Korea .....U.M. 1994-80

Signed and Sealed this

Fourteenth Day of December 1982

[SEAL]

*Attest:*

GERALD J. MOSSINGHOFF

*Attesting Officer*

*Commissioner of Patents and Trademarks*